US006637495B1

(12) United States Patent
Ballor

(10) Patent No.: US 6,637,495 B1
(45) Date of Patent: Oct. 28, 2003

(54) METHOD AND APPARATUS FOR MOLDING WIND CHIMES WITH GLASS INSERTS

(76) Inventor: Steven J. Ballor, 4562 E. Elmwood St., Mesa, AZ (US) 85205

( * ) Notice: Subject to any disclaimer, the term of this patent is extended or adjusted under 35 U.S.C. 154(b) by 0 days.

(21) Appl. No.: 10/116,516

(22) Filed: Apr. 4, 2002

(51) Int. Cl.[7] ..... B22D 19/00
(52) U.S. Cl. ..... 164/98; 164/103; 164/105
(58) Field of Search ..... 164/98, 103, 105

(56) References Cited

U.S. PATENT DOCUMENTS 3,662,809 A * 5/1972 Gotheidge et al. ..... 164/53
4,555,259 A * 11/1985 Williamson ..... 164/98
4,908,923 A * 3/1990 Anderson et al. ..... 164/98
5,259,435 A * 11/1993 Miura et al. ..... 164/97
5,441,777 A * 8/1995 Howell ..... 428/11
6,441,284 B1 * 8/2002 Greene ..... 84/402

* cited by examiner

*Primary Examiner*—Tom Dunn
*Assistant Examiner*—I. H. Lin
(74) *Attorney, Agent, or Firm*—Tod R. Nissle, P.C.

(57) ABSTRACT

A method and apparatus for molding wind chimes reduces the likelihood that a glass insert will fracture when they are placed in a mold and the mold is charged with molten metal. The casting temperature of the molten metal is adjusted to compensate for the surface area of the glass insert that is contacted by the molten metal. The glass insert are annealed prior to molding. A flexible mold is utilized. The tolerances of the glass insert are carefully controlled. The molded wind chime is carefully cooled.

1 Claim, 5 Drawing Sheets

FIG. 1
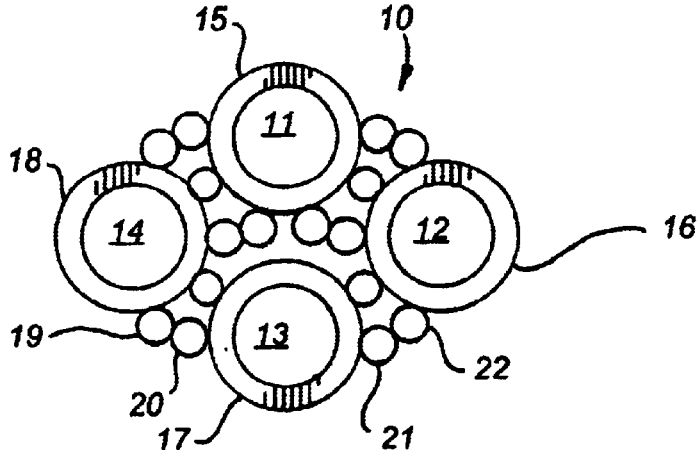
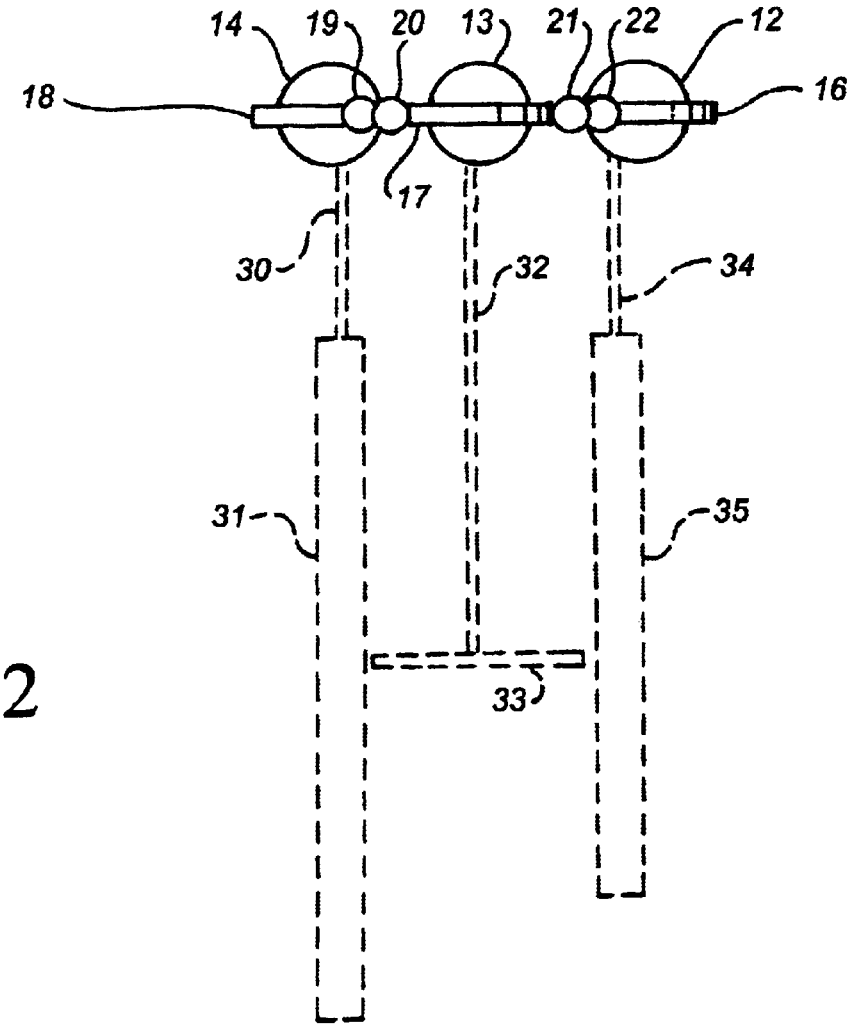
FIG. 2

METHOD AND APPARATUS FOR MOLDING WIND CHIMES WITH GLASS INSERTS

FIELD OF THE INVENTION

This invention relates to wind chimes.

More particularly, the invention relates to a method for molding wind chimes with glass inserts.

In a further respect, the invention relates to a wind chime molding method that reduces the likelihood that the stresses acting on glass inserts in a molded metal wind chime will cause the glass inserts to fracture when vibrations and sound waves produced during operation of the wind chime emanate into the glass inserts.

BACKGROUND AND SUMMARY OF THE INVENTION

Wind chimes have existed for many years and typically comprise small tubes or pieces of metal suspended from a frame along with a ringer that is positioned intermediate the tubes of metal and that causes the tubes of metal to vibrate or "ring" when the wind moves the tubes into contact the ringer.

Wind chimes often are made from brass or other metals. Attempting to incorporate glass pieces into the metal apparently has not been accomplished, particularly when the glass pieces are intended to be included in a mold into which molten metal is poured, contacts the glass pieces, and cools. Contacting glass with molten metal is difficult because the metal and glass have different coefficients of thermal expansion, which can cause the metal, when it cools, to "squeeze" the glass and cause the glass to fracture. The high temperature of molten metal can also cause the glass to fracture due to thermal shock. Another problem inherent in wind chimes is that when the wind chime is used, it produces vibrations and sound waves which can react with stresses in the glass and cause the glass to fracture even though the glass did not fracture when the glass was originally contacted with molten metal to produce the wind chime. Wind chimes normally include a plurality of different length tubes or chimes. Each chime produces a different sound. Each of these different sounds has a different frequency, making it more likely that one of the frequencies produced will function to aggravate residual stress point in a glass insert and will cause the glass to fracture. The aesthetic value of a metal—glass combination in a wind chime or other device is, however, significant and desirable, as is the ability to use molten metal and glass inserts in molds to produce a high volume of wind chimes. Accordingly, it would be highly desirable to provide a process for using molten metal to mold wind chimes or other devices with glass inserts.

Therefore, it is a principal object of the instant invention to provide an improved method for making a wind chime.

A further object of the invention is to provide an improved method for using molten metal to produce wind chimes and other devices that include glass inserts that contact the metal.

BRIEF DESCRIPTION OF THE DRAWINGS

These, and other and further and more specific objects of the invention, will be apparent to those skilled in the art based on the following description, taken in conjunction with the drawings, in which:

FIG. 1 is a top view illustrating a wind chime support member made in accordance with the principles of the invention and including glass inserts;

FIG. 2 is a side view of the wind chime support member of FIG. 1 illustrating further construction details thereof;

DETAILED DESCRIPTION

Figure 3:
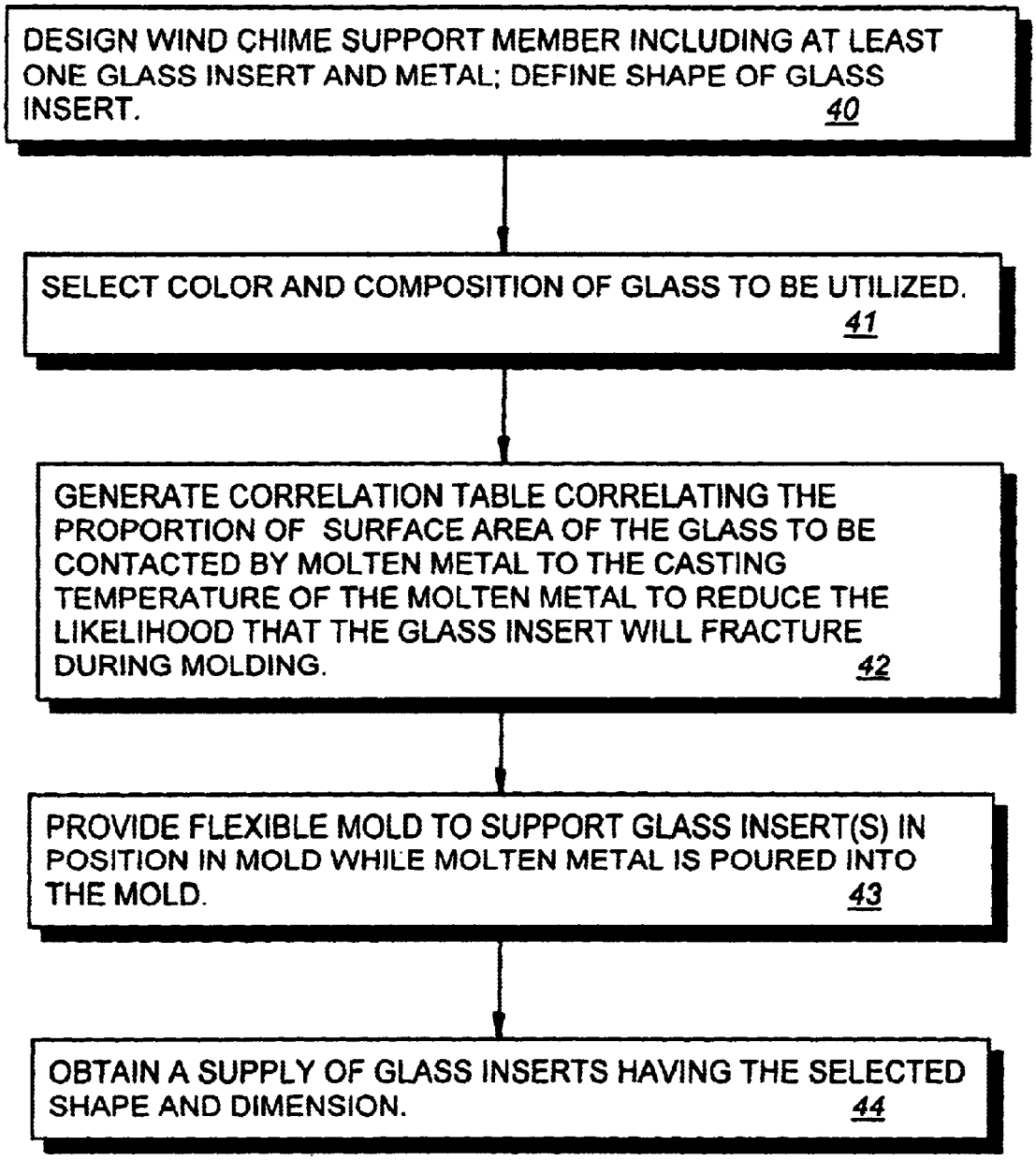
FIG. 3 is a block flow diagram illustrating steps in a method for producing a wind chime in accordance with the invention.

Briefly, in accordance with the invention, I provide an improved method for manufacturing a wind chime. The method includes the steps of designing a wind chime support member including at least one glass insert and metal, the glass insert having a selected shape and dimension; providing a mold to support the glass insert in position while a selected molten metal is poured into the mold to contact the glass insert; obtaining a supply of glass inserts with the selected shape and dimension; sizing the glass inserts in the supply to insure the glass inserts in the supply are within plus or minus three percent of the selected shape and dimension; heating metal to produce molten metal having a temperature in the range of 150 degrees F. to 600 degrees F.; heating the glass insert to a temperature in the range of 100 degrees F. to 300 degrees F.; placing the glass insert in the mold; and, pouring the molten metal into the mold.

In another embodiment of the invention, I provide an improved method for manufacturing a wind chime. The method includes the steps of designing a wind chime support member including at least one glass insert and metal, the glass insert having a selected shape and dimension; providing a mold to support the glass insert in position while a selected molten metal is poured into the mold to contact the glass insert; obtaining a supply of glass inserts with the selected shape and dimension; heating metal to produce molten metal; heating the glass insert to an elevated temperature greater than 100 degrees F.; placing the glass insert in the mold; pouring the molten metal into the mold; allowing the molten metal to solidify into a wind chime member and cool to less than about 200 degrees F.; removing the wind chime member, including the glass insert, from the mold; placing the wind chime member in a soap bath heated to a temperature in the range of 150 degree F. to 200 degrees F.; removing the wind chime member from the soap bath; allowing the wind chime member to cool to within at least 50 degrees F. of room temperature; and, rinsing the wind chime member in an aqueous solution.

In a further embodiment of the invention, I provide an improved method for manufacturing a wind chime. The method includes the steps of designing a wind chime support member including at least one glass insert and metal, the glass insert having a selected shape and dimension; providing a flexible mold to support the glass insert in position while a selected molten metal is poured into the mold to contact the glass insert; obtaining a supply of glass inserts with the selected shape and dimension; heating metal to produce molten metal; heating the glass insert to an elevated temperature greater than 100 degrees F.; placing the glass insert in the flexible mold; pouring the molten metal into the flexible mold; allowing the molten metal to cool and solidify into a wind chime member; and, removing the wind chime member, including the glass insert, from the flexible mold.

In still another embodiment of the invention, I provide an improved method for manufacturing a wind chime. The improved method includes the steps of designing a wind chime support member including at least one glass insert and metal, the glass insert having a selected shape and dimension; generating a correlation table correlating the surface area of the glass insert to be contacted by molten metal to the casting temperature to reduce the likelihood that the glass insert will fracture during molding; determining the proportion of the surface area of the glass insert to be contacted by metal; providing a mold to support the glass insert in position while a selected molten metal is poured into the mold to contact the glass insert; using said correlation table to determine the casting temperature of the metal to be poured into the mold and contact the glass insert; obtaining a supply of glass inserts with the selected shape and dimension; sizing the glass inserts in the supply to insure the glass inserts in the supply are within a selected tolerance of the selected shape and dimension; heating metal to the casting temperature to produce molten metal; pre-heating the glass insert to a temperature in the range of 100 degrees F. to 400 degrees F.; placing the heated glass insert in the mold; and, pouring the molten metal into the mold to contact the pre-heated glass insert.

Turning now to the drawings, which describe the presently preferred embodiments of the invention for the purpose of describing the operation and use thereof and not by way of limitation of the scope of the invention, and in which like reference characters refer to corresponding elements throughout the several views, FIGS. 1 and 2 illustrate a molded wind chime member 10 including a plurality of spherical glass inserts 11 to 14. Molded metal rings 15 to 18 circumscribe and partially encapsulate each glass insert 11 to 14, respectively. Rings 15 to 18 are interconnected by a plurality of molded metal spheres 19 to 22. During the manufacture of member 10, a mold is prepared in which inserts 11 to 14 are positioned. Molten metal is then poured into the mold. The molten metal contacts inserts 11 to 14 and hardens to form the interconnected pattern of rings 15 to 18 and the metal spheres 19 to 22.

As shown in FIG. 2, strands of string or other material 30, 32, 34 are used to suspend tubular chimes 31, 35 and ringer 33 from member 10. Chimes 31, 35 and ringer 33 can be fabricated from any desired material, but typically are fabricated from a metal. Each chime usually, but not necessarily, produces a different sound when the chime contacts ringer 33. The sound produced by chime 31 is different than the sound proudced by chime 35.

Figure 4:
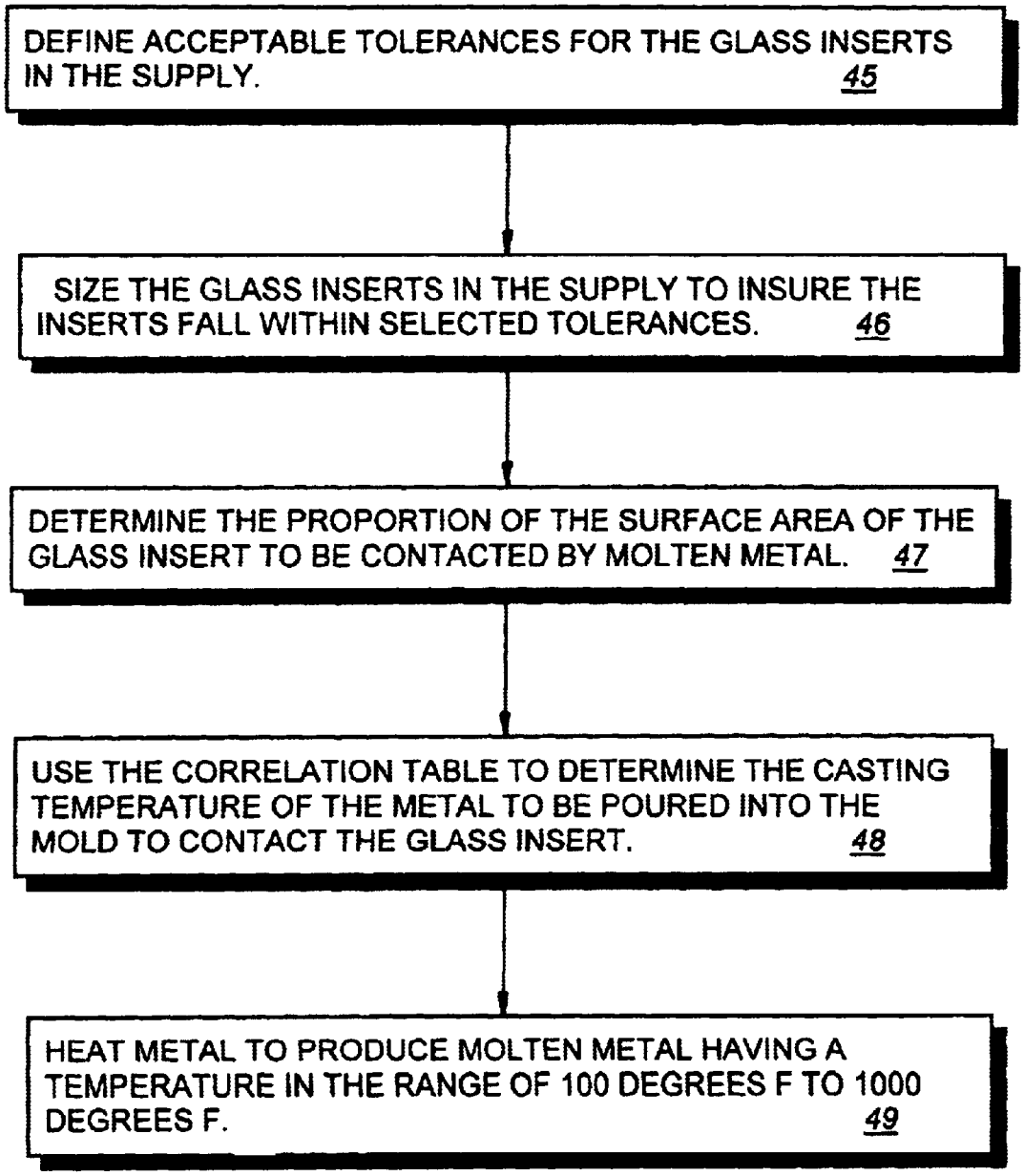
FIG. 4 is a block flow diagram illustrating further steps in a method for producing a wind chime.
Figure 5:
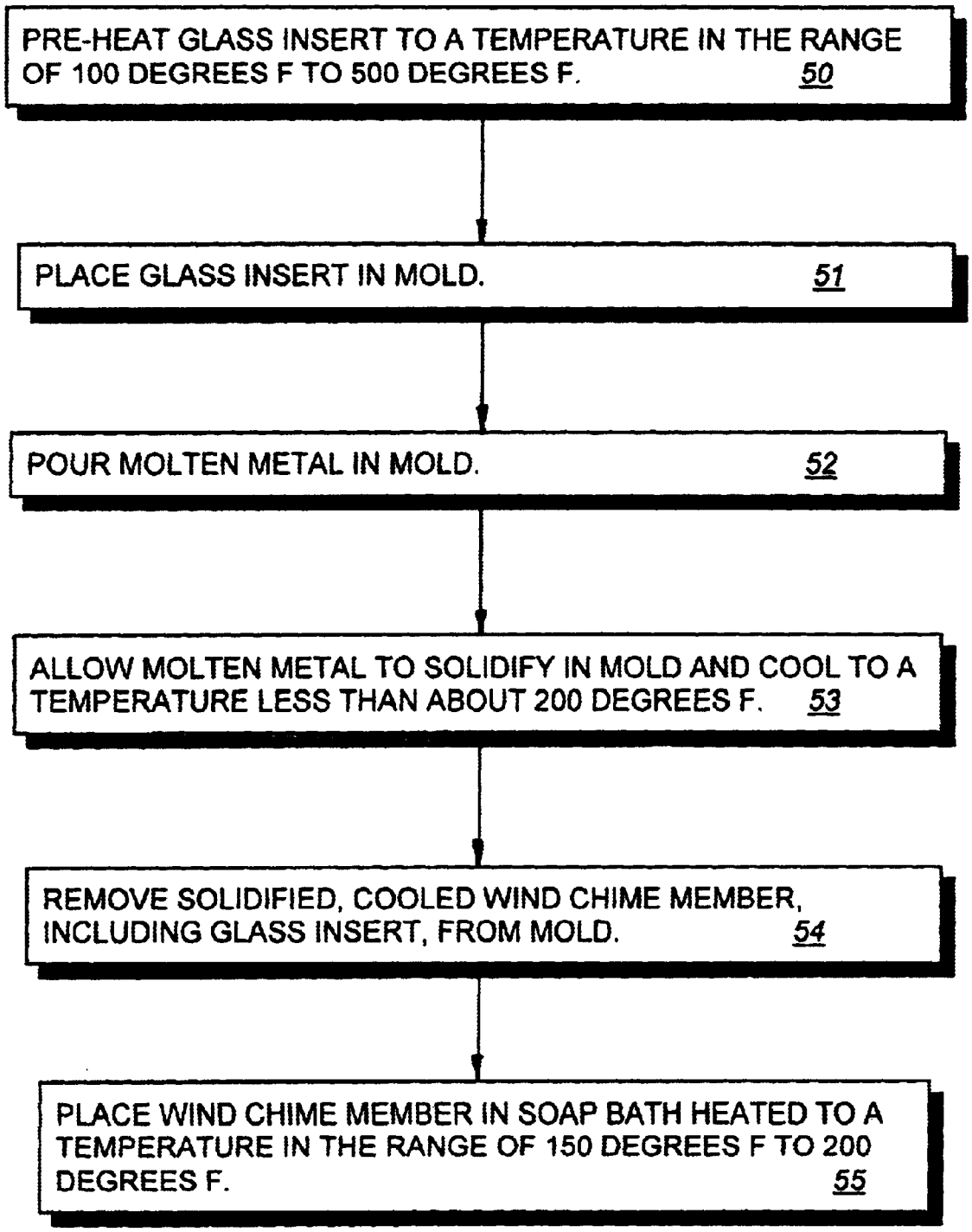
FIG. 5 is a block flow diagram illustrating still other steps in a method for producing a wind chime; and, FIG. 6 is a block flow diagram illustrating yet further steps in a method for producing a wind chime.
Figure 6:
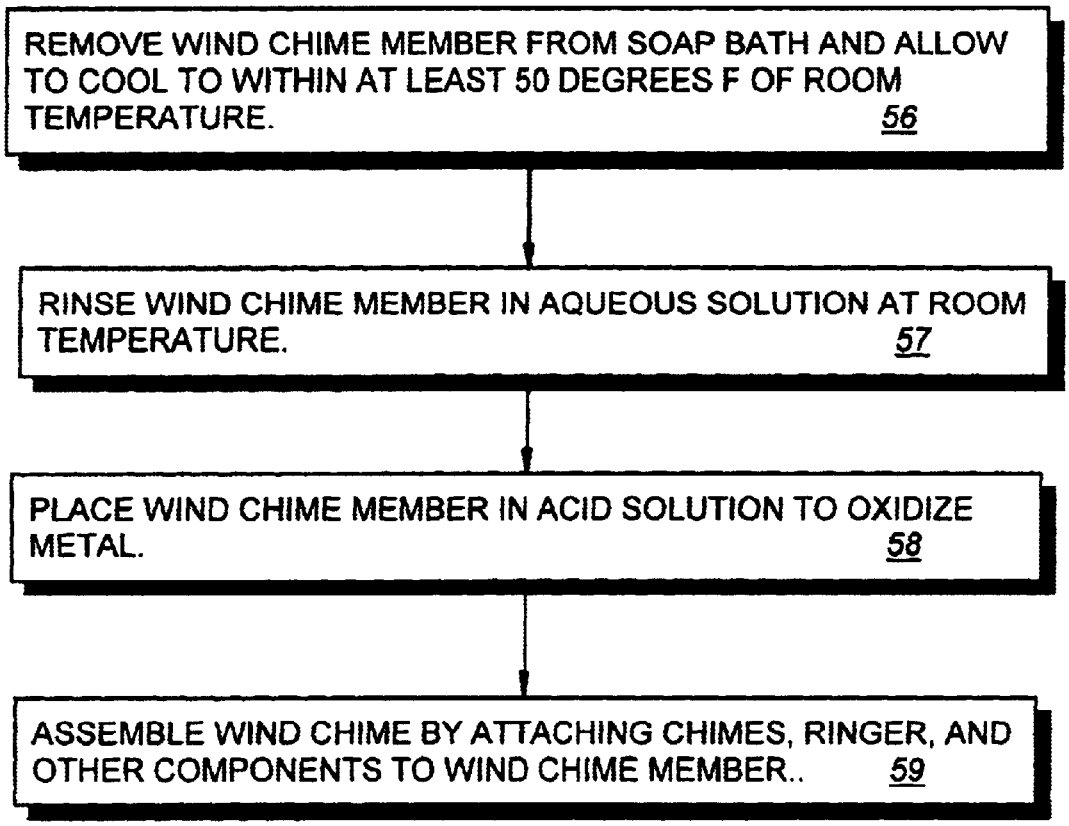

A method for fabricating a wind chime or other decorative device in accordance with the invention is described with reference to FIGS. 3 to 6.

In step 40, a wind chime support member is designed and includes at least one glass insert and metal. The shape and dimension of the glass insert is defined.

In step 41, the color and composition of the glass insert are selected. This is an important step, because some glasses are more likely to fracture due to thermal stress or compression than are other glasses. For example, some colored glasses are more sensitive to thermal stress or to compression.

In step 42, a correlation table is generated. This table correlates, for the particular glass being utilized, the proportion of the surface area of the glass that is contacted by molten metal in the mold to the desired casting temperature to reduce the likelihood that the glass insert will fracture or that the molten metal will cool prematurely. Once such correlation table for a green glass made from a calcium silicate base is shown below in Table I.

TABLE I

Correlation of Proportion of Surface Area to Casting Temperature For Particular Size of Glass Insert

| Size of Insert (Width in millimeters) | Proportion of Surface Area of Glass Insert Contacted by Molten Metal in Mold (%) | | |
|---|---|---|---|
| | 10 to 24 | 25 to 49 | 50 or more |
| 12 | 150 | 200 | 250 |
| 14 | 150 | 200 | 250 |
| 16 | 150 | 200 | 250 |
| 20 | 150 | 200 | 250 |
| 24 | 150 | 200 | 250 |
| 25 | 200 | 250 | 300 |
| 35 | 200 | 250 | 300 |
| 42 | 200 | 300 | 350 |
| 50 | 250 | 350 | 400 |

The numbers to the right of the numbers in the "Size of Insert" column in Table I indicate preferred casting temperature in degrees F. For example, if a 16 mm wide glass insert has 15% of its total surface area contacted by molten metal in the mold, then the recommended casting temperature (i.e., recommended temperature of the molten metal when the metal is poured into the mold) is 150 degrees F. If a 42 mm wide glass insert has 35% of its total surface area contacted by molten metal in the mold, then in Table I the recommended casting temperature is 300 degrees F., and so on. One reason Table I is important is that as the surface area of the glass insert that is contacted by molten metal increases, the metal is more likely to cool too quickly and solidify at the glass insert—metal interface. If the metal solidifies too quickly, it is more likely that the glass insert will fracture or be unduly stressed. It is desirable, and important, that the molten metal tend to cool more as a unit, particularly at the interface of the molten metal and glass insert. Tables like Table I can be readily generated by experimentation, and the desired casting temperatures can be selected as desired. While a higher casting temperature may be necessary as the surface area of a glass insert contacted by molten metal increases, a lower casting temperature is, when possible, preferred, because at higher casting temperatures, it is more likely that the glass insert will experience thermal shock and fracture. The principle purpose of Table I is to insure that the casting temperature is high enough to prevent premature cooling of molten metal at the molten metal—glass insert interface.

In step 43, a flexible mold is provided to support glass insert(s) in position in the mold while molten metal is poured into the mold. While the mold need not be fabricated of silicone or some flexible material, a flexible material is preferred in the practice of the invention because a flexible mold can resiliently expand and compensate for uneven rates of expansion or contraction. This expansion and contraction of a flexible mold helps to protect the glass insert(s) from damage as the molten metal cools.

In step 44, a supply of glass inserts is obtained. The glass inserts generally have the desired selected shape and dimension.

In step 45, acceptable tolerances for the glass insert(s) are defined. These tolerances are important, because if the glass insert is larger or smaller, the insert may not properly position itself in the mold, the glass insert may be more susceptible to thermal shock, the casting temperature may vary, etc. While acceptable tolerances can be defined as desired, it is presently preferred that each glass insert be within plus or minus 5%, preferably plus or minus 3%, of the defined dimensions of the glass insert. By way of example, a glass insert is within plus or minus 5% of the defined dimensions as long as each selected measurement of the insert (i.e., for width, height, volume, surface area, etc.) Is within 5% of selected shape and dimension of the insert. In some case, a glass insert may be deemed within the selected shape and dimension as long as the width and height measurements of the insert are within 5% of the selected shape and dimension. In other case, a glass insert may be deemed within the selected shape and dimension as long as the volume and surface area measurements of the insert are within 5% of the selected shape and dimension. And so on.

In step 46, the glass inserts in the supply are sized to confirm that the inserts are within selected tolerances. If the inserts are not within acceptable tolerances, the inserts are not used in the mold.

In step 47, a determination is made of the proportion of the surface area of the glass insert to be contacted by molten metal in the mold. Determining the portion of the surface area of a spherical insert 11 to 14 in the wind chime member 10 in FIG. 1 that is contacted by metal is a straightforward matter because the diameter (and therefore the surface area) of each insert 11 to 14 is known and because the thickness of each ring 15 to 18 is known. Consequently, the surface area around the center of each insert 11 to 14 that is contacted by its associated ring 15 to 18, respectively, is readily calculated and compared to the total surface area of insert 11 to 14 so that percentage of the total surface area of the insert that is contacted by its associated ring 15 to 18 is readily determined. The proportion of the surface area of an insert 11 to 14 contacted by a ring 15 to 18 in FIG. 1 is in the range of 10% to 24% of the total surface area of the insert.

In step 48, the correlation Table I is used to determine the casting temperature of the metal to be poured into the mold to contact the glass insert. If the casting is twenty-five millimeters wide, and the proportion of the surface area contacted by metal is in the range of 10% to 24%, then the casting temperature according to Table I is 200 degrees F.

In step 49, metal is heated to produce molten metal having a temperature in the range of 100 degrees F. to 1000 degrees F., preferably 100 degrees F. to 600 degrees F. Any metal can be selected, but pewter and other low melting temperature metals are presently preferred.

In step 50, the glass insert(s) is pre-heated to a temperature in the range of 100 degrees F. to 500 degrees F., preferably 100 degrees F. to 400 degrees F. This is an important step because pre-heating the glass reduces the temperature differential between the glass insert and the molten metal, minimizing thermal shock and reducing the likelihood that the glass insert will fracture while the metal and glass cool simultaneously.

In step 51, the pre-heated glass insert is placed in the mold.

In step 52, the molten metal is poured into the mold at the desired casting temperature.

In step 53, the molten metal is allowed to solidify in the mold and cool to a temperature less than about 200 degrees F. It is understood that the metal can be removed from the mold at any time and any temperature after it solidifies, but it is presently preferred to allow the metal to cool to about 200 degrees F.

In step 54, the solidified, cooled wind chime member, including the glass insert is removed from the mold.

In step 55, the wind chime member is placed in a soap bath heated to a temperature in the range of 150 degrees F. to 200 degrees F. Placing the wind chime member in a soap bath is optional, but is preferred in the event an acid will be used to oxidize the metal. The temperature difference between the wind chime member and the soap bath is preferably less than about 50 degrees F. to reduce the risk that the glass inserts will shatter on being placed in the soap bath.

In step 56, the wind chime member is removed from the soap bath and is allowed to cool slowly. Typically the wind chime member is simply allowed to cool in the ambient air to within 50 degrees of room temperature.

In step 57, the wind chime member is placed in an aqueous solution to rinse the wind chime member. The aqueous solution is at room temperature. The temperature differential between the wind chime member and the aqueous solution is preferably less than 50 degrees F.

In step 58, the wind chime member is placed in an acid solution to oxide the metal. The wind chime member is rinsed in an aqueous solution after it is placed in the acid solution.

In step 59, a wind chime is assembled by attaching chimes 31 and 35, a ringer 33, and other components 30, 32, 34 (including, if desired, additional metal or metal—glass insert members) to the wind chime member 10.

As earlier noted, the method of the invention can be utilized to make other object out of metal and glass inserts. Such objects can include, without limitation, picture frames, key fobs, and lamp bases. The vibrations and sound waves produced by wind chimes required more particular methodologies to reduce the risk that the glass inserts would fracture while the wind chimes are in use.

Having described my invention in such terms as to enable those of skill in the art to understand and practice it, and having described the presently preferred embodiments and best mode thereof, I claim:

1. A method for manufacturing a wind chime, including the steps of (a) designing a wind chime support member including at least one glass insert and metal, said glass insert having a selected shape and dimension;

(b) generating a correlation table correlating the surface area of the glass insert to be contacted by molten metal to the casting temperature to reduce the likelihood that the glass insert will fracture during molding;

(c) determining the proportion of the surface area of said glass insert to be contacted by metal;

(d) providing a mold to support said glass insert in position while a selected molten metal is poured into the mold to contact each of the glass inserts;

(e) using said correlation table to determine the casting temperature of the metal to be poured into the mold and contact the glass insert;

(f) obtaining a supply of glass inserts with said shape and dimension;

(g) sizing the glass inserts in said supply to insure the glass inserts in said supply are within a selected tolerance of said selected shape and dimension;

(h) heating metal to said casting temperature to produce molten metal;

(i) pre-heating said glass insert to a temperature in the range of 100 degrees F. to 300 degrees F.;

(j) placing said heated glass insert in said mold;

(k) pouring said molten metal into said mold to contact said pre-heated glass insert.

* * * * *